US007210679B2

(12) United States Patent
Schäfer et al.

(10) Patent No.: US 7,210,679 B2
(45) Date of Patent: May 1, 2007

(54) METHOD FOR CONVEYING SHEETS THROUGH A PRINTING MACHINE AND APPARATUS FOR IMPLEMENTING THE METHOD

(75) Inventors: Thomas Schäfer, Heidelberg (DE); Jürgen Fürbass, Wiesloch (DE); Andrew McLellan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 93 days.

(21) Appl. No.: 10/896,379

(22) Filed: Jul. 21, 2004

(65) Prior Publication Data

US 2005/0067761 A1 Mar. 31, 2005

(30) Foreign Application Priority Data

Jul. 21, 2003 (DE) ..... 103 32 970

(51) Int. Cl.
*B65H 29/68* (2006.01)

(52) U.S. Cl. ..... 271/183

(58) Field of Classification Search ..... 271/183, 271/196, 182, 73, 310, 197, 202; 101/37
See application file for complete search history.

(56) References Cited

U.S. PATENT DOCUMENTS 4,173,301 A 11/1979 Turini et al.
4,202,542 A * 5/1980 Lammers et al. ..... 271/276
4,222,326 A * 9/1980 Mathes et al. ..... 101/183
4,273,324 A * 6/1981 Philipp ..... 271/183
4,693,462 A * 9/1987 Pollich ..... 271/183
4,830,355 A * 5/1989 Jeschke ..... 271/183
5,005,816 A 4/1991 Stemmler et al.
5,165,679 A * 11/1992 Kinomoto ..... 271/197
5,186,451 A * 2/1993 Hirao ..... 271/196
5,251,891 A * 10/1993 Blaser et al. ..... 271/176
5,575,207 A * 11/1996 Shimizu ..... 101/232
5,810,350 A * 9/1998 Pollich ..... 271/276
5,833,231 A 11/1998 Schreiner
6,000,695 A * 12/1999 Mack et al. ..... 271/303
6,056,287 A * 5/2000 Hirth et al. ..... 271/204
6,176,482 B1 * 1/2001 Reinhard et al. ..... 271/227
6,209,867 B1 * 4/2001 Madsen et al. ..... 271/276
6,264,190 B1 * 7/2001 Aoki ..... 271/183
6,273,417 B1 * 8/2001 Berlingen et al. ..... 271/183

(Continued)

FOREIGN PATENT DOCUMENTS

DE 27 07 170 C2 8/1978

(Continued)

*Primary Examiner*—Patrick Mackey
*Assistant Examiner*—Jeremy R. Severson
(74) *Attorney, Agent, or Firm*—Laurence A. Greenberg; Werner H. Stemer; Ralph E. Locher

(57) ABSTRACT

A method for conveying sheets through a printing machine and an apparatus for conveying the sheets permit adaptation of a sheet brake to various sheet thicknesses by reducing a speed of the sheets in the direction of advance by bringing the sheets individually one after another into contact with at least one suction element moved in the direction of advance, and by holding each sheet by the action of a suction apparatus on the suction element along a conveying section, dependent upon the sheet thickness, the suction action of the suction element along the conveying section is changed locally.

1 Claim, 4 Drawing Sheets

U.S. PATENT DOCUMENTS

| | | | | |
|---|---|---|---|---|
| 6,338,482 | B1 * | 1/2002 | Geske et al. | 271/202 |
| 6,340,155 | B1 * | 1/2002 | Madsen et al. | 271/183 |
| 6,454,259 | B1 * | 9/2002 | Madsen et al. | 271/276 |
| 6,494,452 | B1 * | 12/2002 | Karasiewicz | 271/276 |
| 6,543,764 | B1 * | 4/2003 | Mallok | 271/183 |
| 6,571,702 | B2 * | 6/2003 | Wotton et al. | 101/232 |
| 6,591,748 | B2 * | 7/2003 | Kerpe et al. | 101/232 |
| 6,598,872 | B1 * | 7/2003 | Gunschera et al. | 271/197 |
| 6,659,453 | B2 * | 12/2003 | Kelm et al. | 271/183 |
| 6,672,720 | B2 * | 1/2004 | Smith | 347/104 |
| 6,691,999 | B2 * | 2/2004 | Gunshera et al. | 271/183 |
| 6,871,849 | B2 * | 3/2005 | Kerpe et al. | 271/182 |
| 6,918,588 | B2 * | 7/2005 | Muller | 271/283 |
| 2001/0008328 | A1 * | 7/2001 | Gunschera et al. | 271/202 |
| 2001/0026042 | A1 * | 10/2001 | Kerpe et al. | 271/183 |
| 2004/0164482 | A1 * | 8/2004 | Edinger | 271/197 |

FOREIGN PATENT DOCUMENTS

| | | | |
|---|---|---|---|
| DE | 28 33 570 | B1 | 12/1979 |
| DE | 32 20 798 | C1 | 1/1984 |
| DE | 36 38 494 | A1 | 8/1987 |
| DE | 38 20 032 | A1 | 12/1989 |
| DE | 41 16 510 | A1 | 12/1991 |
| DE | 44 38 922 | A1 | 5/1996 |
| DE | 195 10 364 | A1 | 9/1996 |
| DE | 196 43 588 | C1 | 10/1997 |
| DE | 196 34 910 | A1 | 3/1998 |
| DE | 197 29 088 | A1 | 1/1999 |
| DE | 102 35 661 | A1 | 2/2004 |

* cited by examiner

METHOD FOR CONVEYING SHEETS THROUGH A PRINTING MACHINE AND APPARATUS FOR IMPLEMENTING THE METHOD

BACKGROUND OF THE INVENTION

Field of the Invention

The invention relates to a method for conveying sheets through a printing machine in which the speed of the sheets in the direction of advance is reduced by the sheets being brought individually one after another into contact with at least one suction element moved in the direction of advance, by each sheet being held by the action of a suction apparatus on the suction element along a conveying section, and to an apparatus for implementing the method. The invention can be used in particular when conveying sheets onto a stack in a press.

German Published, Non-Prosecuted patent application Ser. No. 36 38 494 A1 describes a sheet feeder for a press, in which, upstream of a delivery stack, a suction belt conveyor is disposed, whose suction belts run in a horizontal portion and in a portion inclined with respect to the delivery stack. The portions are provided with separate suction chambers. The speed of the suction belts can be adjusted continuously. On the side of the suction boxes facing the suction belts, suction openings having a constant cross-section are provided.

In the sheet conveying device in the feeder and delivery of a press according to German Published, Non-Prosecuted patent application Ser. No. 197 29 088 A1, L-shaped toothed belts are used. Between the belts there are suction chambers. Each suction chamber contains a suction opening lying in the sheet-conveying plane, whose width corresponds to the distance between sealing measures of the two belts and whose length is defined by the configuration. The suction chambers can be acted on separately with vacuum.

The known sheet brakes have the disadvantage that, as a result of the fixedly predefined position and geometry of the vacuum openings, it is not possible for all types of printing material to be decelerated without contact and without smearing. The vacuum openings represent a compromise that, when very thin or very thick sheets are being conveyed, has a detrimental effect on the quality of the sheets. The conveyance of sheets can be carried out at low speed, but this means that the productivity of the printing machine decreases.

SUMMARY OF THE INVENTION

It is accordingly an object of the invention to provide a method for conveying sheets through a printing machine and apparatus for implementing the method that overcome the hereinafore-mentioned disadvantages of the heretofore-known devices of this general type and that permits adaptation of a sheet brake to various sheet thicknesses.

With the foregoing and other objects in view, there is provided, in accordance with the invention, a method for conveying sheets through a printing machine, including the steps of reducing a speed of the sheets in a conveying direction by individually bringing the sheets one after another into contact with at least one suction element moved in the conveying direction and holding each sheet by action of a suction apparatus upon the at least one suction element along a conveying section and locally changing a suction action of the at least one suction element along the conveying section dependent upon a thickness of a sheet.

The present invention makes it possible to adapt the number of effective suction openings, their position, length, and geometry, to the sheet thickness or grammage to be conveyed in each case. The invention can be used in conveying apparatuses having braking stations where a suction belt, suction roll, or a suction disc is used as the element attracting the sheet by suction.

In accordance with another mode of the invention, suction belts that interact with an easily manually interchangeable suction duct insert are used as braking elements. Depending on whether thin sheets or board sheets are to be conveyed, various suction duct inserts are used, differing in the number and geometry or position of the suction openings.

In accordance with a further mode of the invention, the suction action of a suction element can also be changed by changing the size of vacuum openings under the suction element or by isolating existing vacuum openings from the vacuum supply in accordance with the sheet thickness.

In accordance with an added mode of the invention, the suction action is changed by changing a position and/or a configuration of vacuum openings under the suction element.

In accordance with an additional mode of the invention, the suction action is changed by changing a size of vacuum openings under the suction element.

In accordance with yet another mode of the invention, the suction action is changed by inserting in each suction element interchangeable suction duct inserts having differently placed vacuum openings.

In accordance with yet a further feature of the invention, the suction action is changed by isolating from a suction air supply individual vacuum openings under the suction element along the conveying section dependent upon a thickness of the sheets.

With the objects of the invention in view, there is also provided a method for conveying sheets through a printing machine, including the steps of reducing a speed of the sheets in a direction of advance by individually bringing the sheets one after another into contact with at least one suction element moved in the advance direction and holding each sheet by action of a suction apparatus upon the suction element along a conveying section and locally changing a suction action of the suction element along the conveying section dependent upon a thickness of a sheet.

With the objects of the invention in view, there is also provided a conveying apparatus for conveying sheets through a printing machine in a conveying direction, the printing machine having a suction apparatus, the conveying apparatus including a braking station having at least one suction belt table with a suction belt for holding and conveying at least one sheet and having at least one part moving in the conveying direction, the suction belt having apertures and a conveying section, an advancing device individually moving sheets to the braking station, the braking station being positioned to receive individual sheets from the advancing device and to contact each of the sheets respectively with the suction belt for reducing the speed of the sheets in a conveying direction, the suction belt table having a supporting surface for supporting the suction belt, an interchangeable suction duct insert removably disposed in the braking station and defining a suction duct having at least one vacuum aperture opening in the supporting surface, the duct insert locally changing a suction action of the suction belt along the conveying section dependent upon a thickness of a sheet, the suction duct to be connected to the suction apparatus, and the suction belt holding each sheet respectively at the conveying section by action of the suction apparatus upon the suction belt.

In accordance with yet an added feature of the invention, the braking station has deflection rollers, the suction belt is guided over the deflection rollers and has a rectilinear, horizontal conveying section and a wrap region adjacent at least one of the deflection rollers and located downstream of the conveying section in the conveying direction, and the at least one vacuum aperture is a plurality of apertures, the apertures including at least one aperture disposed in a region of the horizontal conveying section and at least another aperture disposed in the wrap region.

In accordance with yet an additional feature of the invention, the braking station has deflection rollers, the suction belt is guided over the deflection rollers and has a rectilinear, horizontal conveying section, and the suction duct insert has an elongated suction opening in a region of the horizontal conveying section.

In accordance with again another feature of the invention, the braking station has a sealing surface for a vacuum, the suction duct insert has a side facing away from the supporting surface, a magnet retains the suction duct insert on the side facing away from the supporting surface, and the suction duct insert rests on a sealing surface for vacuum.

In accordance with again a further feature of the invention, the suction belt table has a pin fixing the suction duct insert in the conveying direction in a fixed position, the suction belt table defines suction holes, the suction duct insert defines vacuum holes, and respective ones of the vacuum holes are aligned with the suction holes when the suction duct insert is in the fixed position.

With the objects of the invention in view, there is also provided an apparatus for implementing the method according to the invention includes a device for advancing individual sheets to a braking station for reducing a speed of the sheets, the braking station having at least one suction belt table with a suction belt for holding and conveying at least one sheet, the suction belt having apertures, the suction belt table having a supporting surface for supporting the suction belt, an interchangeable suction duct insert defining a suction duct having at least one vacuum aperture opening in the supporting surface, and the suction duct to be connected to a suction apparatus.

Other features that are considered as characteristic for the invention are set forth in the appended claims.

Although the invention is illustrated and described herein as embodied in a method for conveying sheets through a printing machine and apparatus for implementing the method, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
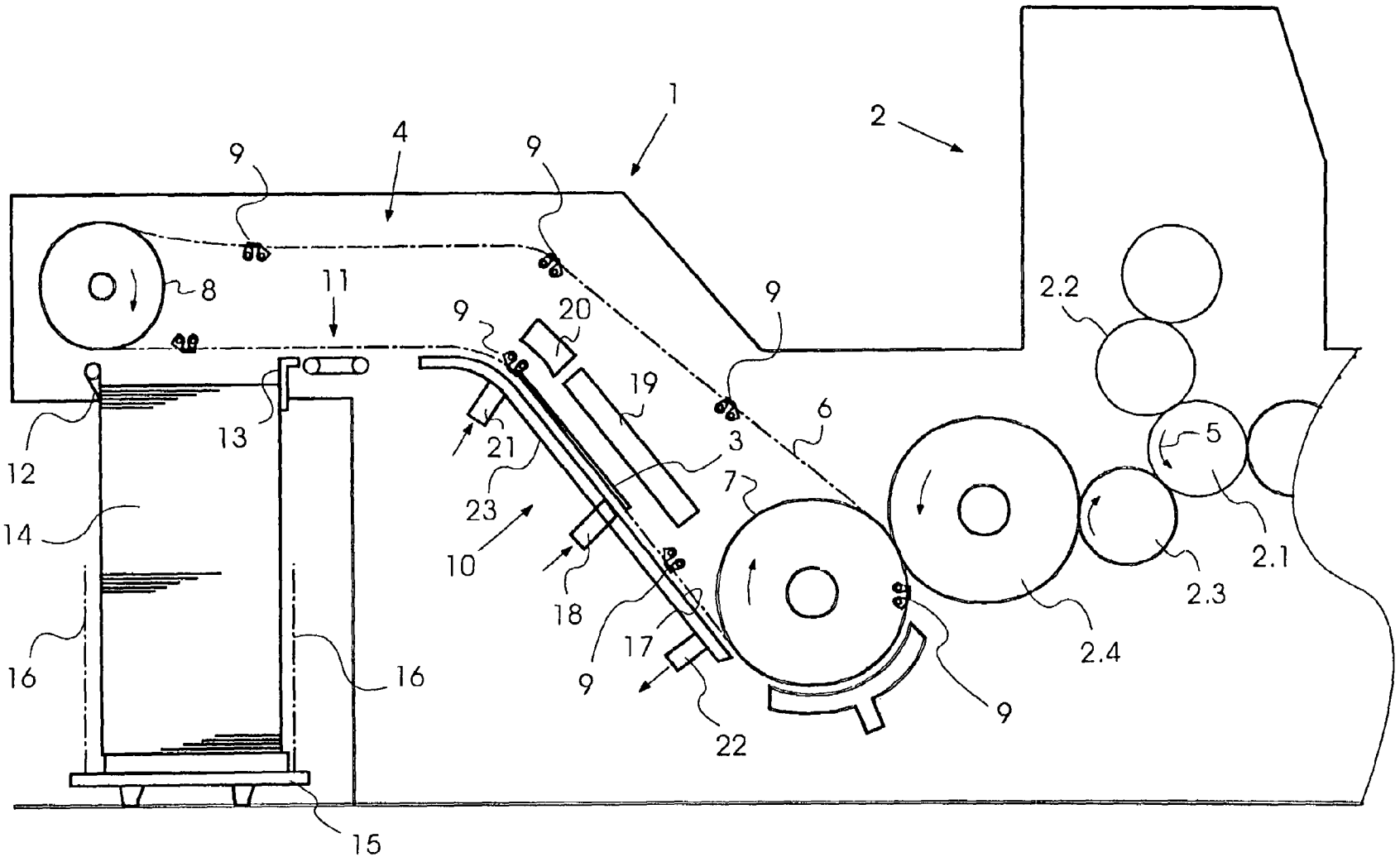
FIG. 1 is a fragmentary, diagrammatic, cross-sectional view of a braking station according to the invention in the delivery of an offset press.

Referring now to the figures of the drawings in detail and first, particularly to FIG. 1 thereof, there is shown a printing unit 2 operating on the offset process with an impression cylinder 2.1. The impression cylinder 2.1 carries a respective sheet in a processing direction indicated by the direction of rotation arrow 5 through a press nip between the impression cylinder 2.1 and a blanket cylinder 2.2 interacting therewith and, in the present example, then transfers it to a row of grippers of a single-turn transfer drum 2.3 while opening a row of grippers disposed on the impression cylinder 2.1 and provided for gripping the sheet 3 at a gripper edge at the leading end of the sheet 3. A corresponding transfer of the sheet 3 is, then, carried out from the single-turn transfer drum 2.3 to a further transfer drum 2.4, which is a half-turn transfer drum in the present example, which finally transfers the sheet 3 to a chain conveyor 4 of the delivery 1. The chain conveyor 4 includes two endless conveyor chains 6, of which a respective one circulates along a closed chain path in the vicinity of a respective side wall of the chain delivery 1 during operation. A respective conveyor chain 6 in each case wraps around one of two synchronously driven drive sprockets 7, whose axes are aligned with each other, and, in the present example, is guided over a deflection sprocket 8 that is, in each case, located opposite the drive sprocket 7 and downstream with respect to the processing direction so that a respective one of the conveyor chains 6 passes through a closed chain path.

Between the two conveyor chains 6 there extend gripper systems 9 carried by the latter and having grippers, which move through gaps between the grippers disposed on the transfer drum 2.4 and, in the process, accept a respective sheet 3 by gripping the aforementioned gripper edge at the leading end of the sheet 3 immediately before the opening of the grippers disposed on the transfer drum 2.4, transport the sheet over a sheet guide apparatus 10 to a braking station 11 and open after the transfer of the sheet 3 to the braking station 11 has taken place. In the braking station 11, the sheets are braked to a depositing speed that is reduced with respect to the processing speed and, after reaching the reduced speed, are finally released so that a respective sheet 3, now decelerated, finally strikes leading edge stops 12 and, being aligned on the latter and on trailing edge stops 13 located opposite them, together with preceding and/or following sheets 3, forms a stack 14 that, by a lifting mechanism, can be lowered to the extent to which the stack 14 grows. Of the lifting mechanism, only a platform 15 carrying the stack 14 and lifting chains 16 carrying the stack 14 and indicated with dash-dotted lines are reproduced in FIG. 1. Along their paths between the drive sprockets 7, on one hand, and the deflection sprockets 8, on the other hand, the conveyor chains 6 are guided by chain guide rails that determine the chain paths of the chain runs. In the present example, the sheets 3 are transported by the lower chain run in FIG. 1. The section of the chain path through which the latter passes is followed by a sheet guide surface 17 facing the section and formed on the sheet guide apparatus 10. Between the surface 17 and the sheet 3 respectively guided over it, a supporting air cushion is, preferably, formed during operation. For such a purpose, the sheet guide apparatus 10 is equipped with blown air nozzles that open into the sheet guide surface 17, of which only one is reproduced in FIG. 1 as representative of all of them and, in a symbolic representation, in the form of a connector 18.

To prevent the printed sheets in the stack 14 from sticking together, a dryer 19 and a powdering apparatus 20 are provided on the path of the sheets 3 from the drive sprockets 7 to the braking station 11. To avoid excessive heating of the sheet guide surface 17 by the dryer, a coolant circuit is integrated into the sheet guide apparatus 10, indicated symbolically in FIG. 1 by an inlet connector 21 and an outlet connector 22 on a coolant trough 23 associated with the sheet guide surface 17. In FIG. 1, an illustration of the aforementioned chain guide rails has been omitted. However, the course of the same in the present example can be seen from that of the chain runs.

Figure 2:
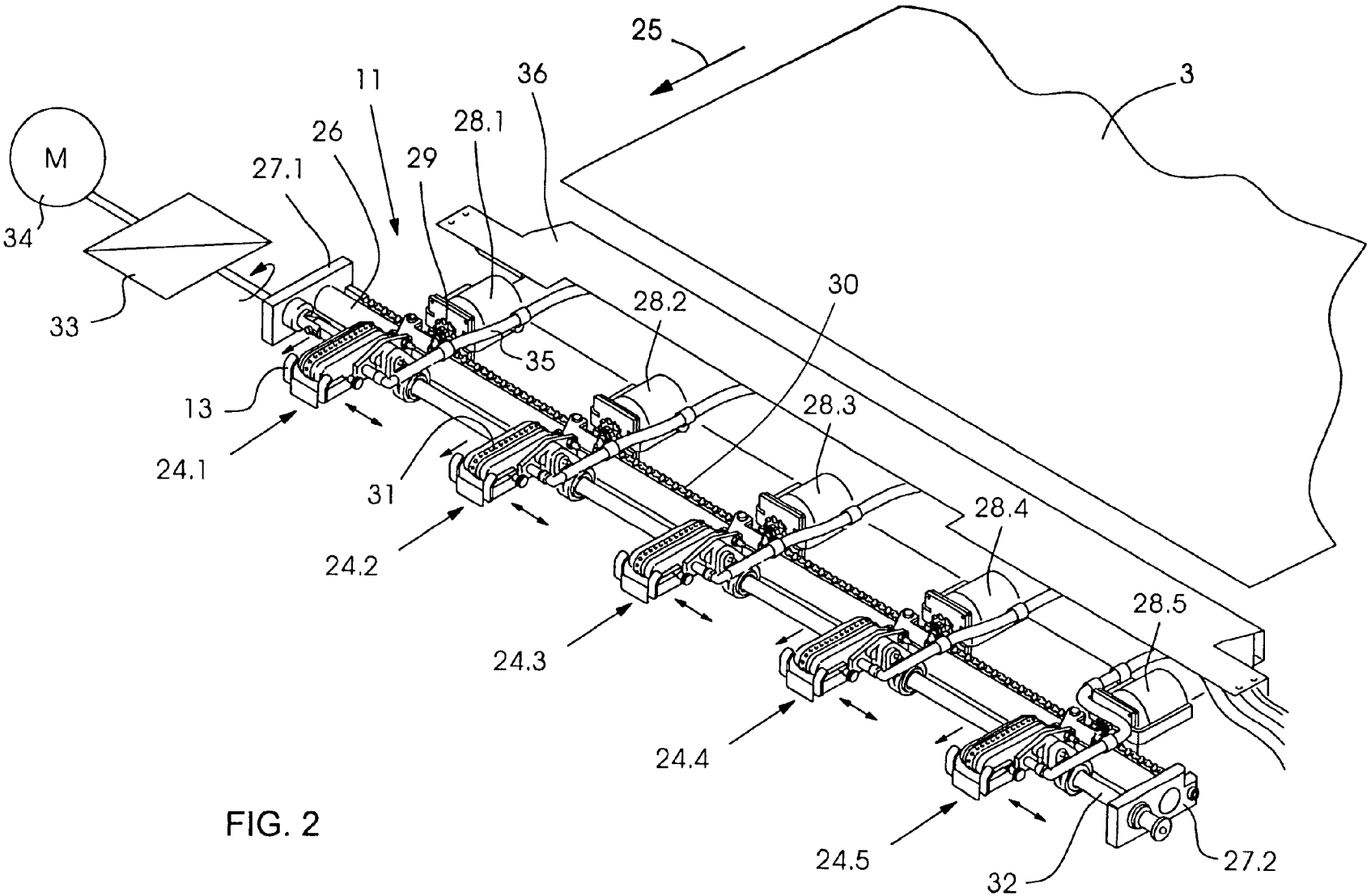
FIG. 2 is a fragmentary, partially perspective and partially schematic view of the braking station of FIG. 1.

The braking station 11 is illustrated in more detail in FIG. 2. The braking station 11 contains five suction belt modules 24.1 to 24.5 in a parallel configuration with respect to the conveying direction 25 of the sheets 3. The suction belt modules 24 can be positioned transversely with respect to the conveying direction 25 on print-free regions of the sheet 3. For such a purpose, the suction belt modules 24 are mounted on a guide rod 26, which is fixed in a frame 27.1, 27.2. The positioning drives provided are stepping motors 28.1 to 28.5, which are coupled to the suction belt modules 24.1 to 24.5. In each case pinions 29 are fixed on the motor shafts of the stepping motors 28 so as to rotate with them and engage in a chain 30, of which the ends are fixed in the frame 27.1, 27.2 and that is aligned parallel to the guide rod 26. The suction belt modules 24 contain suction belts 31, which are guided over deflection rollers. The suction belts 31 are driven synchronously, by, in each case, coupling a deflection roller to a shaft 32 that is rotatably mounted in the frame 27.1, 27.2. The shaft 32 is coupled to a gearbox 33 and a motor 34. Underneath the suction belts 31 there are suction ducts, which are connected to a vacuum source through lines 35. The lines 35 are laid in a hose duct 36 such that they can move. The trailing edge stops 13 are fixed to the suction belt modules 24. To adapt to different length formats of the sheets 3, the entire braking station 11 described in FIG. 2, including the suction belt modules 24, can be positioned in the conveying direction 25 in the delivery 1.

To adapt to different grammages of the sheets 3, the suction belt modules 24 are equipped with replaceable suction duct inserts 37, 38, which will be explained in more detail in side view and plan view by using FIGS. 3A, 3B, 4A, and 4B. A suction belt 31 is laid over deflection rollers 39, 40. A suction table 41 has a supporting surface 42 on the upper side and lateral guides for the suction belt 31 on the underside. Centrally in relation to the suction belt 31 there is in the suction table 41 a groove 43, into which the suction duct insert 37 or 38 is inserted. To accommodate a suction duct insert 37, 38, the front deflection roller 40 is divided into two. Both suction duct inserts 37, 38 have on an upper side thereof a supporting surface 44, which lies in the plane of the supporting surface 42 in a horizontal region 45 and which is rounded of if, corresponding to the shape of the deflection roller 40, in a sector 46 of the deflection roller 40 placed downstream. On the underside of the suction duct inserts 37, 38 there is a fitting hole 47 to accommodate a dowel pin 48 located in the suction table 41, and a retaining magnet 49 in a countersink 50 in the suction table 41. Aligning suction ducts 51, 52 are introduced into the suction table 41 and into the suction duct inserts 37, 28. The underside of a auction duct insert 37, 38 rests in a sealing manner on a surface 53 of the groove 43.

Figure 3A:
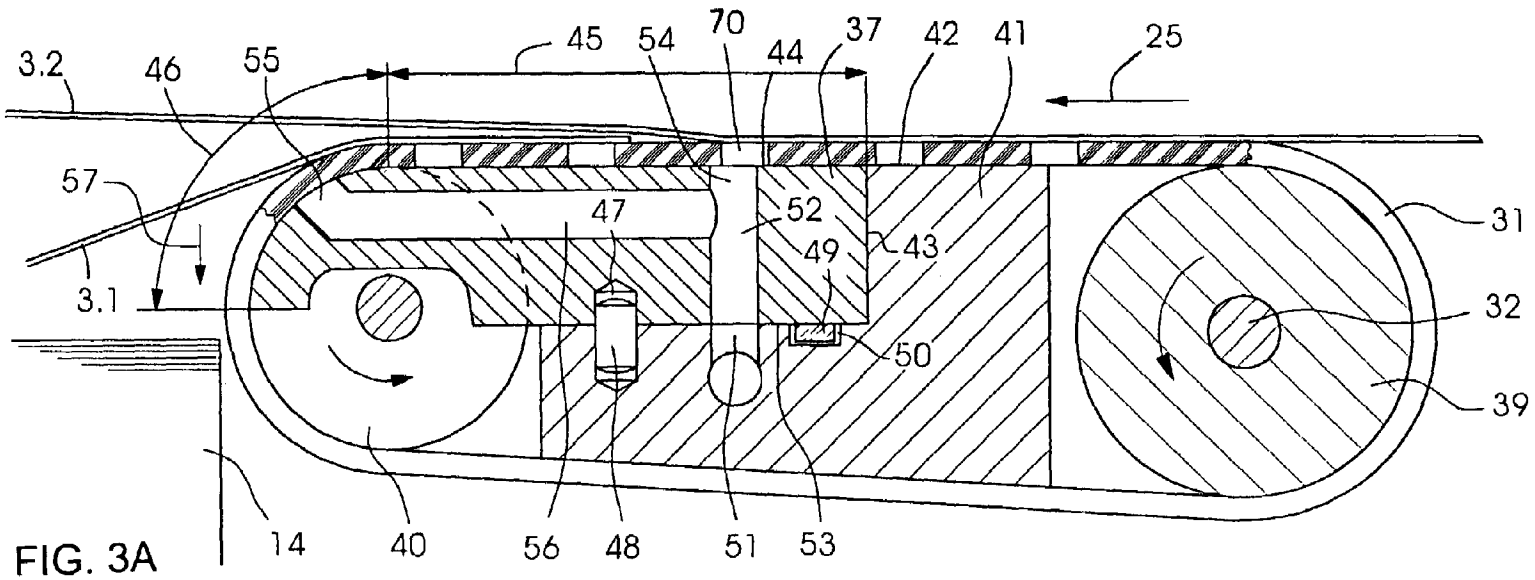
FIG. 3A is a fragmentary, cross-sectional side view of a suction duct insert according to the invention for thin grammages.
Figure 3B:
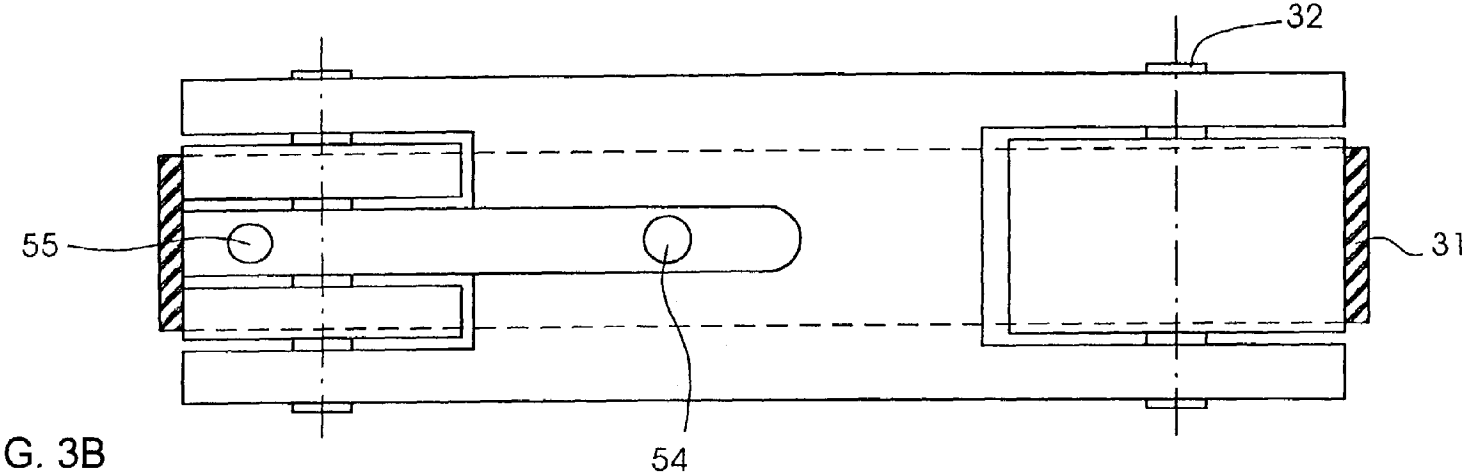
FIG. 3B is a partially plan and partially hidden view of the suction duct insert of FIG. 3A.

The suction duct insert 37 illustrated in FIGS. 3A and 3B is used to convey sheets 3 with a low sheet thickness. On the side facing the suction belt 31 there are two suction openings 54, 55 in the suction duct insert 37. The first suction opening 54 is located in the horizontal region 45 and is connected directly to the suction duct 52. The second suction opening 55 is located in the sector 46 and is connected to the suction duct 52 through a transverse duct 56. The suction duct 51 is connected to the aforesaid vacuum source through the line 35.

As illustrated in FIGS. 3A and 3B, on the suction belt 31 there is a sheet 3.1 that is moving off onto the stack 14, and a following sheet 3.2, which is still held on the gripper system 9 at its leading edge. The suction opening 54, in conjunction with a large number of apertures 70 introduced into the suction belt 31, has the effect of attracting the sheet 3.2 onto the suction belt 31 by suction. The suction opening 55 in the sector 46 has the effect of reducing the speed and guiding the sheet 3.1 running off. The configuration of the suction openings 54, 55 makes it possible to guide the sheet 3.1 as far as possible over a large conveying distance. By the action of the suction opening 55, the sheet 3.1 is still moved downwards slightly in the vertical direction 57. The suction openings 54, 55 have a spacing in the conveying direction 25, so that, as the sheet 3.1 runs off onto the stack 14, the following sheet 3.2 can already be attracted by suction without the sheets 3.1, 3.2 touching.

Figure 4A:
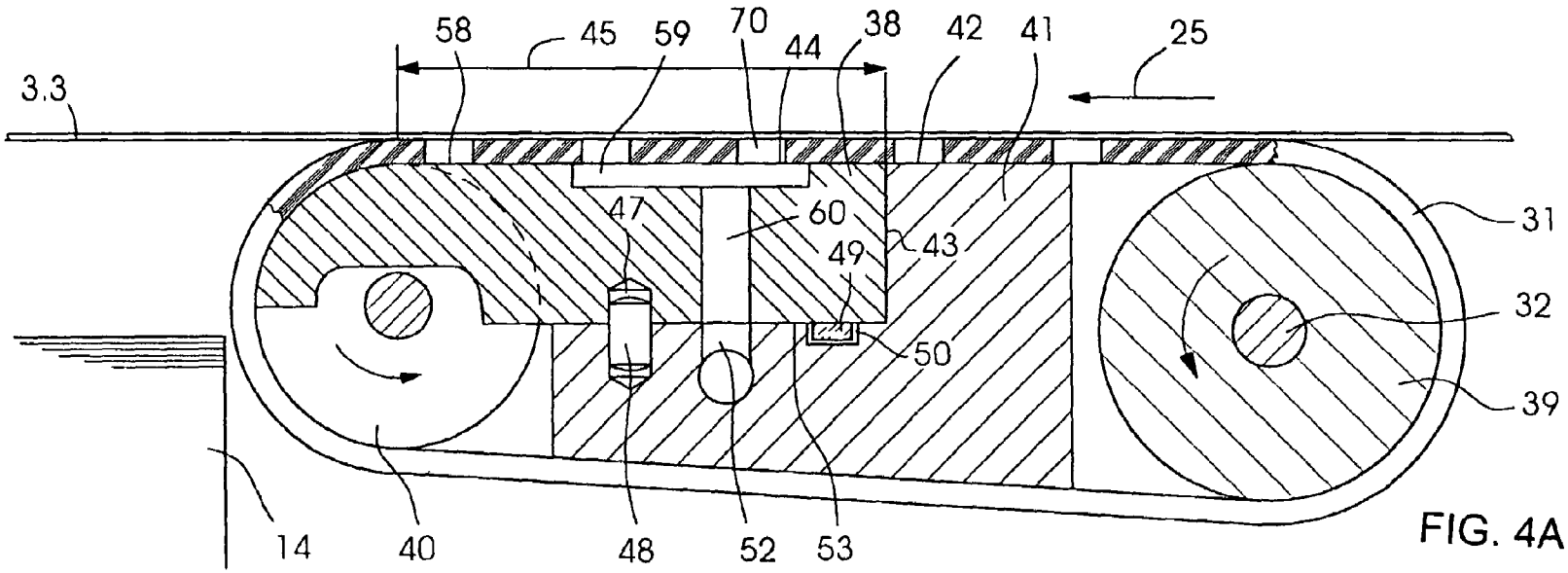
FIG. 4A is a fragmentary, cross-sectional side view of a suction duct insert according to the invention for board sheets.
Figure 4B:
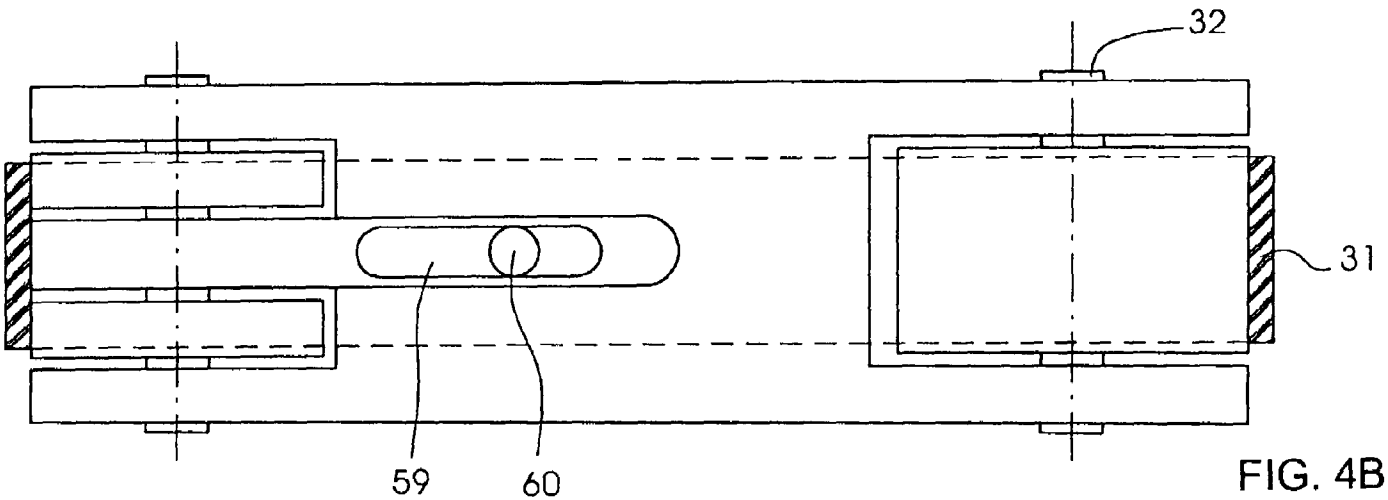
FIG. 4B is a partially plan and partially hidden view of the suction duct insert of FIG. 4A.

In the case of board sheets 3.3, use is made of a suction duct insert 38 having a different suction geometry than the suction duct insert 37 for thin sheets 3.1, 3.2. As shown in FIGS. 4A and 4B, on the upper side of the suction duct insert 38, at the level of the supporting surface 42, there is a supporting surface 58 into which an elongated duct 59 is machined. A suction duct 60 that, when the suction duct insert 38 is inserted into the dowel pin 48, is aligned with the suction duct 52 in the suction table 41, opens in the duct 59. The duct 59 is disposed in that part of the horizontal region 45 that is placed upstream. There is no suction opening in the region of the front deflection roller 40 because a board sheet 3.3 would not match the curvature of the deflection roller 40 and leakages would occur, which have a detrimental effect on the useful braking force on the sheet 3.3. By the action of the duct 59, the sheet 3.3 is attracted onto the suction belt 31 by suction in interaction with the apertures 70 so that the sheet 3.3 rests flat on the suction belt 31 and is guided substantially horizontally.

This application claims the priority, under 35 U.S.C. § 119, of German patent application Ser. No. 103 32 970.6, filed Jul. 21, 2003; the entire disclosure of the prior application is herewith incorporated by reference.

We claim:

1. A method for conveying sheets through a printing machine, which comprises:

reducing a speed of the sheets in a conveying direction by individually bringing the sheets one after another into contact with at least one suction element moved in the conveying direction and holding each sheet by action of a suction apparatus upon the at least one suction element along a conveying section; and inserting in each suction element interchangeable suction duct inserts having differently placed vacuum openings for locally changing a suction action of the at least one suction element along the conveying section dependent upon a thickness of a sheet.

* * * * *